US005319168A

United States Patent [19]

Hutko et al.

[11] Patent Number: 5,319,168

[45] Date of Patent: Jun. 7, 1994

[54] CIRCUIT BREAKER RETRACTABLE HANDLE MECHANISM

[75] Inventors: Gary J. Hutko, Wilmington, N.C.; Brian C. Livingston, Churchill Boro; Yu W. Chou, Moon Township, Allegheny County, both of Pa.

[73] Assignee: Westinghouse Electric Corp., Pittsburgh, Pa.

[21] Appl. No.: 169

[22] Filed: Jan. 4, 1993

[51] Int. Cl.[5] ..... H01H 3/04

[52] U.S. Cl. ..... 200/331; 200/332; 200/337

[58] Field of Search ..... 200/332, 337, 338, 331, 200/43.14

[56] References Cited

U.S. PATENT DOCUMENTS

| | | | |
|---|---|---|---|
| 1,928,487 | 9/1933 | Hammerly | 200/337 |
| 3,159,048 | 12/1964 | Clifford | 200/331 X |
| 3,821,532 | 6/1974 | Isaac, Jr. et al. | 200/338 X |
| 4,115,669 | 9/1978 | Cali | 200/331 |
| 4,150,271 | 4/1979 | McMillen | 200/332 X |
| 4,465,911 | 8/1984 | Ootsuka | 200/331 |
| 5,193,666 | 3/1993 | Markowski et al. | 200/331 |

*Primary Examiner*—Renee S. Luebke

*Attorney, Agent, or Firm*—Gary R. Jarosik

[57] ABSTRACT

A retractable handle mechanism for controlling the operating handle of a circuit breaker. The handle mechanism consists of a housing which may be mounted on an electrical enclosure in which the circuit breaker may be disposed. Pivotally attached to the housing is a first lever which is movable between an on position and an off position. Retractably attached to the first lever is a second lever which is movable between a first position substantially adjacent the first lever and a second position substantially extended away from the first lever. The retractable handle mechanism may also be equipped with a lever restraining mechanism which allows the second lever to be non-movably disposed in either its first position or its second position. The retractable handle mechanism may also be equipped with a lever off locking mechanism which prevents the first lever from being moved from the off position to the on position.

10 Claims, 7 Drawing Sheets

CIRCUIT BREAKER RETRACTABLE HANDLE MECHANISM

BACKGROUND OF THE INVENTION

This invention relates generally to lever mechanisms for circuit breakers and more particularly to a retractable lever mechanism for use with circuit breakers disposed in an electrical enclosure.

A common circuit breaker has a pivot handle which moves linearly between an on and an off position. The pivot handle is connected to the movable contacts within the circuit breaker assembly through a spring powered, over center toggle device. When the handle is moved into the on position, the movable contacts close upon themselves completing an electrical circuit. When the handle is moved into the off position, the movable contacts separate from each other interrupting the electrical circuit. In response to certain overcurrent conditions, the contacts open automatically causing the handle to move to an intermediate position.

Often in application, these circuit breakers are mounted behind a door in an electrical enclosure. Typically in these installations, the pivot handle of the circuit breaker will protrude through an opening in the door where it can be operated directly. This configuration leaves the circuit breaker exposed to the environment where damage to the components of the breaker may result. To solve this problem, circuit breakers are now equipped with an interface between the operating handle and the outside of the electrical enclosure whereby the circuit breaker is sealed from the hazards of the environment. This interface often is a flange-mounted, linearly movable, pivot handle operator.

While the typical pivot handle operator provides the desired interface between the person operating the breaker and the breaker itself, it has been found that the lever is often difficult to use. This problem is attributable to safety requirements and size constraints which have necessitated that the handle operator lever be limited to a small size. In particular, the small amount of leverage that can be generated from the short lever makes it difficult for the operator to overcome the spring force which loads the over-center toggle device of the breaker when the operator switches the breaker between the on and off positions. Typically, operators use crow-bars or like instruments in conjunction with the operator handle to increase the amount of leverage that may be applied to these devices. This results in exposing the device as well as the operator to potential harm.

A need exists for a circuit breaker handle operator which will provide increased leverage while still remaining small enough to fulfill the industries safety requirements and size constraints.

SUMMARY OF THE INVENTION

This invention proposes a solution to the problem of providing a circuit breaker handle operator capable of providing increased leverage which remains within acceptable size limitations and constraints. The solution utilizes a retractable handle mechanism comprising a housing which is mounted on an electrical enclosure in which a circuit breaker is disposed. This housing has a first lever which is pivotally attached to the housing and linked to the operating handle of the circuit breaker. Retractably attached to this first lever is a second lever which has the capability of being extended outward from the first lever to provide increased leverage when in use and for being positioned substantially adjacent the first lever for maintaining a safe size when not in use.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION OF THE INVENTION

Figure 1:
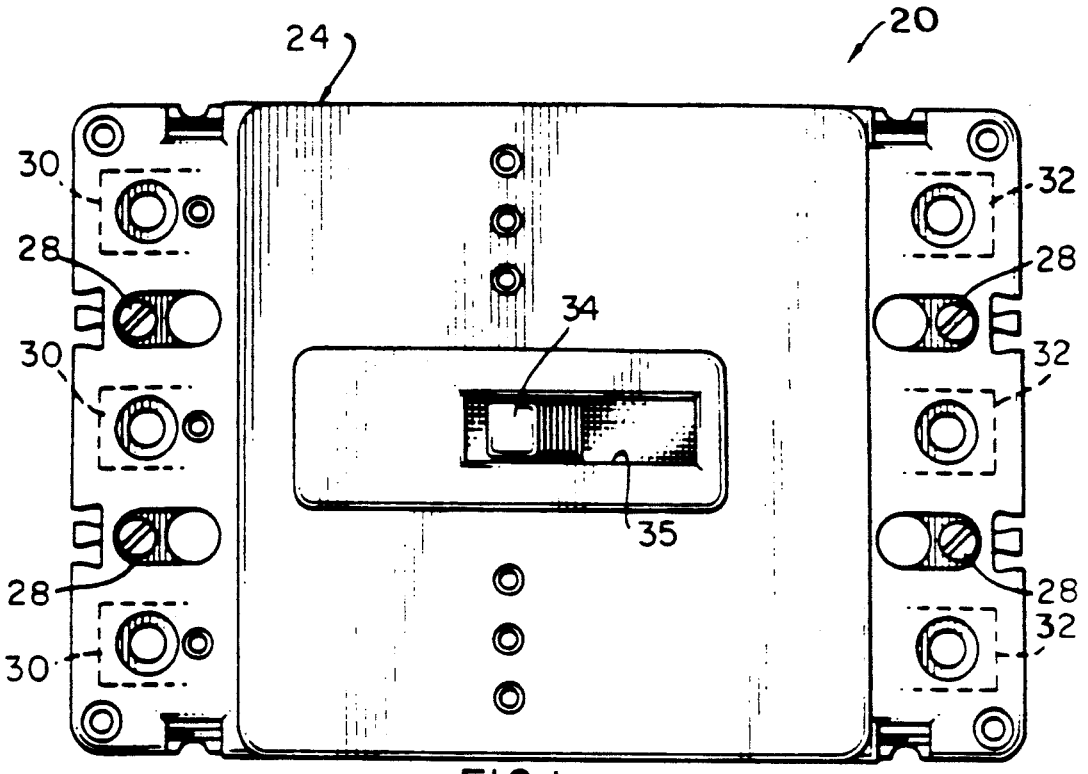
FIG. 1 shows a plan view of a molded case circuit breaker.
Figure 2:
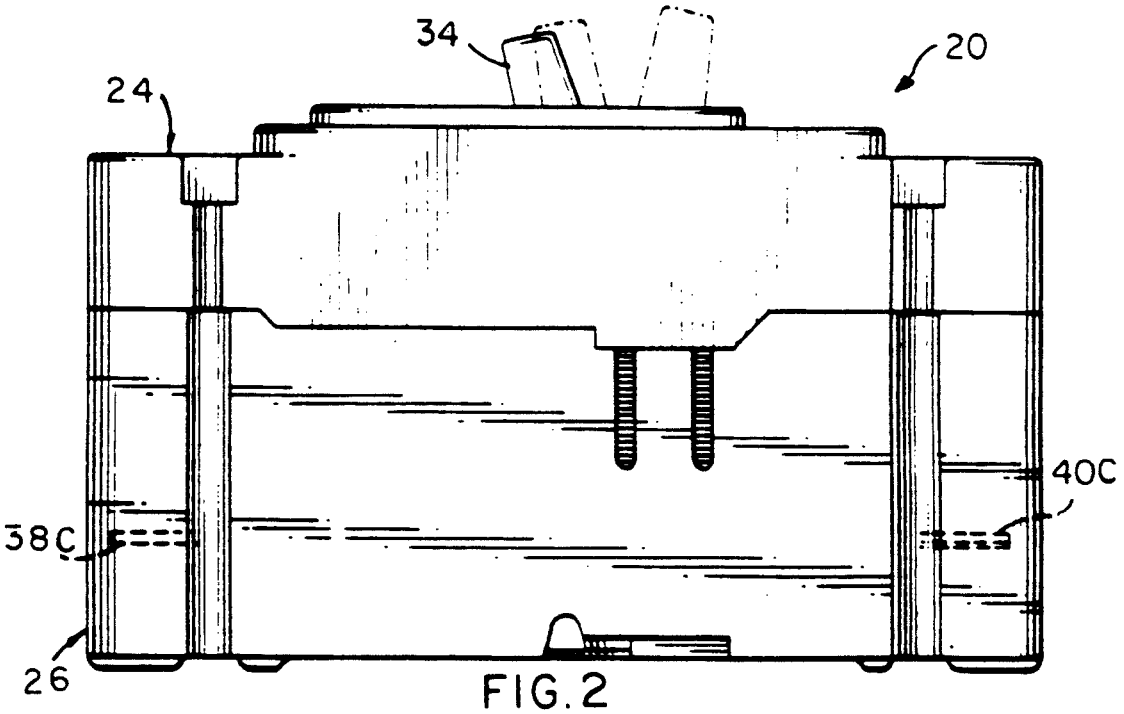
FIG. 2 shows a side elevational view of the device of FIG. 1.

Referring to the drawings and initially FIGS. 1–4, there is illustrated a molded case circuit breaker 20 and an electrical enclosure 22. A retractable handle mechanism constructed in accordance with the principles of the present disclosure is described hereinafter with respect to FIGS. 3–8. While the circuit breaker 20 is depicted and described herein as a three phase or three pole circuit breaker (similar to that disclosed in U.S. Pat. No. 4,630,019, issued Dec. 16, 1986, owned by the assignee of the present invention and incorporated herein by reference) and the electrical enclosure 22 is depicted and described as the flange mounting type, the principles of the present disclosure are equally applicable to any type of circuit breaker and electrical enclosure combination.

The circuit breaker 20 includes a molded, electrically insulating, top cover 24 mechanically secured to a molded, electrically insulating, bottom cover or base 26 by a plurality of fasteners 28. A plurality of first electrical terminals or line terminals 30 are provided, one for each pole or phase, as are a plurality of second electrical terminals or load terminals 32. These terminals are used to serially electrically connect the circuit breaker 20 into a three phase electrical circuit for protecting a three phase electrical system.

The circuit breaker 20 may further include an electrically insulating, rigid, manually engageable handle 34 extending through an opening 35 in the top cover 24 for setting the circuit breaker to its closed or on position where the electrical contacts within the breaker (not visible) are engaged or to its open or off position where the electrical contacts within the breaker are separated. The circuit breaker 20 may also assume a blown open or tripped position during predetermined over-current conditions wherein the electrical contacts separate and the handle 34 assumes a position between the on position and the off position. Subsequent to being placed in its tripped position, the circuit breaker 20 may be reset for further protective operation by moving the handle 34 from the tripped position past its off position. The handle 34 may then be left in its off position or moved to its on position in which case the circuit breaker 20 is ready for further protective operation.

Figure 3:
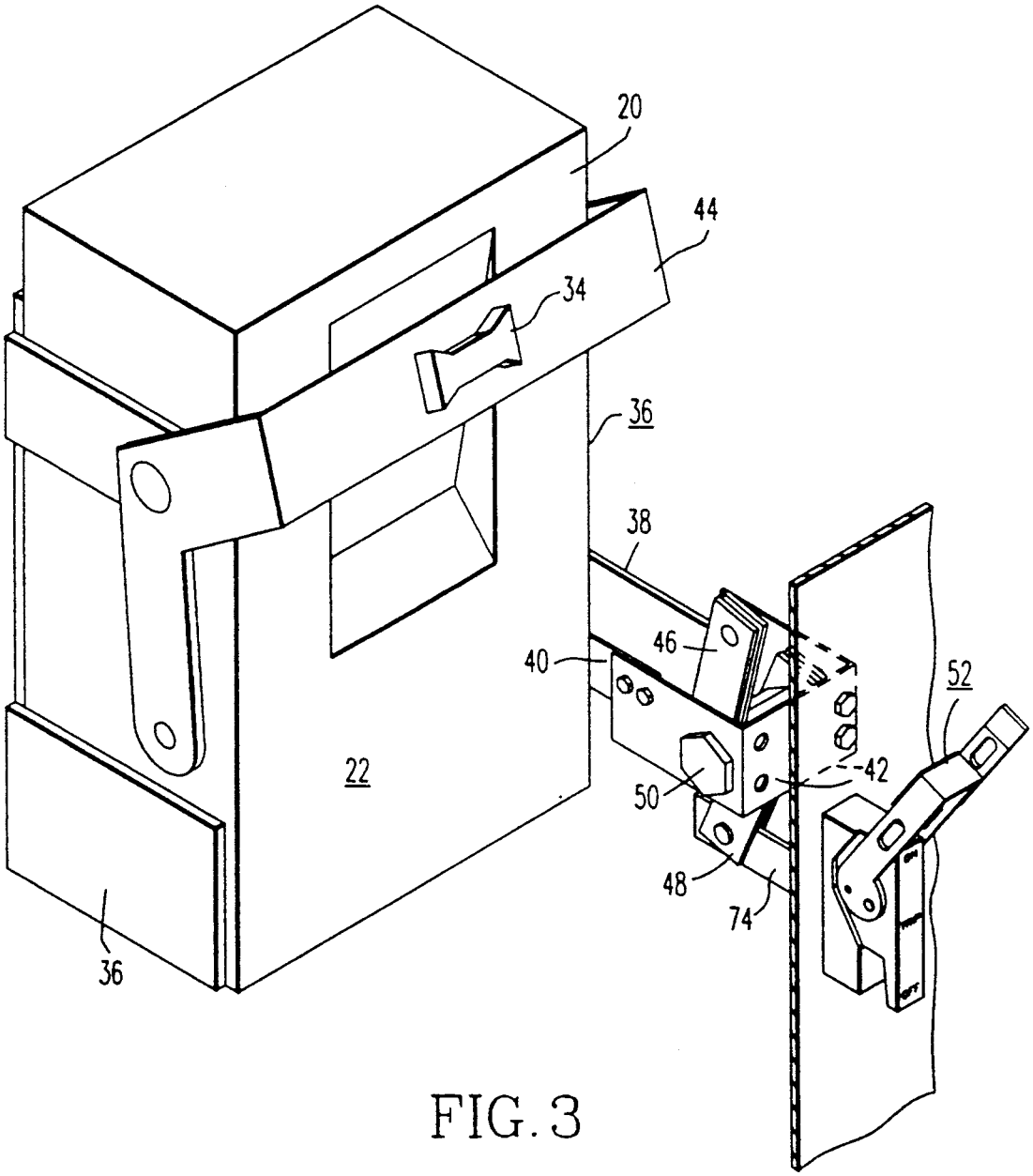
FIG. 3 shows an orthogonal view of the circuit breaker disposed in an electrical enclosure and connected to the retractable handle mechanism.
Figure 4:
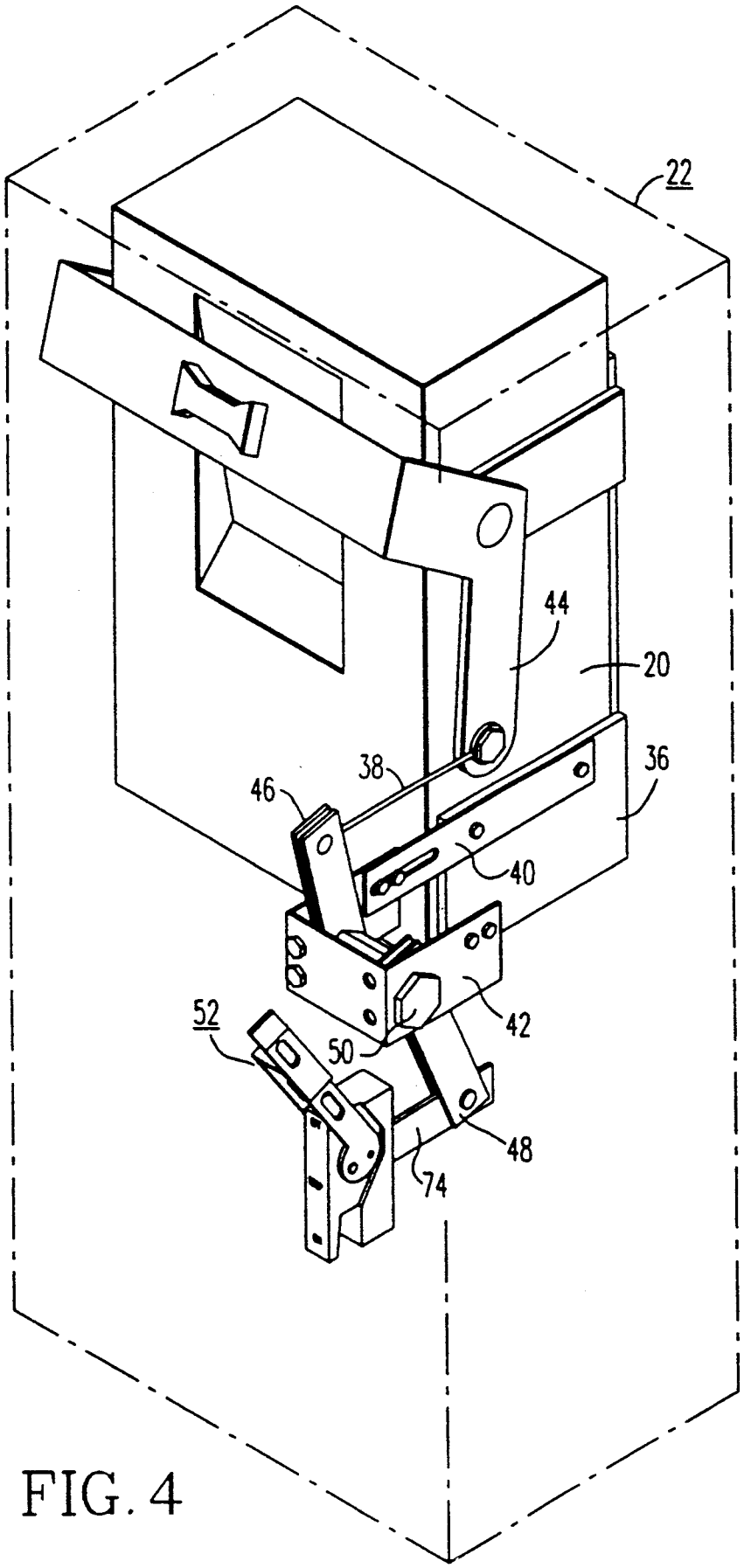
FIG. 4 shows an orthogonal view of the assembly of FIG. 3 through a cut-away section of the electrical enclosure.
Figure 5:
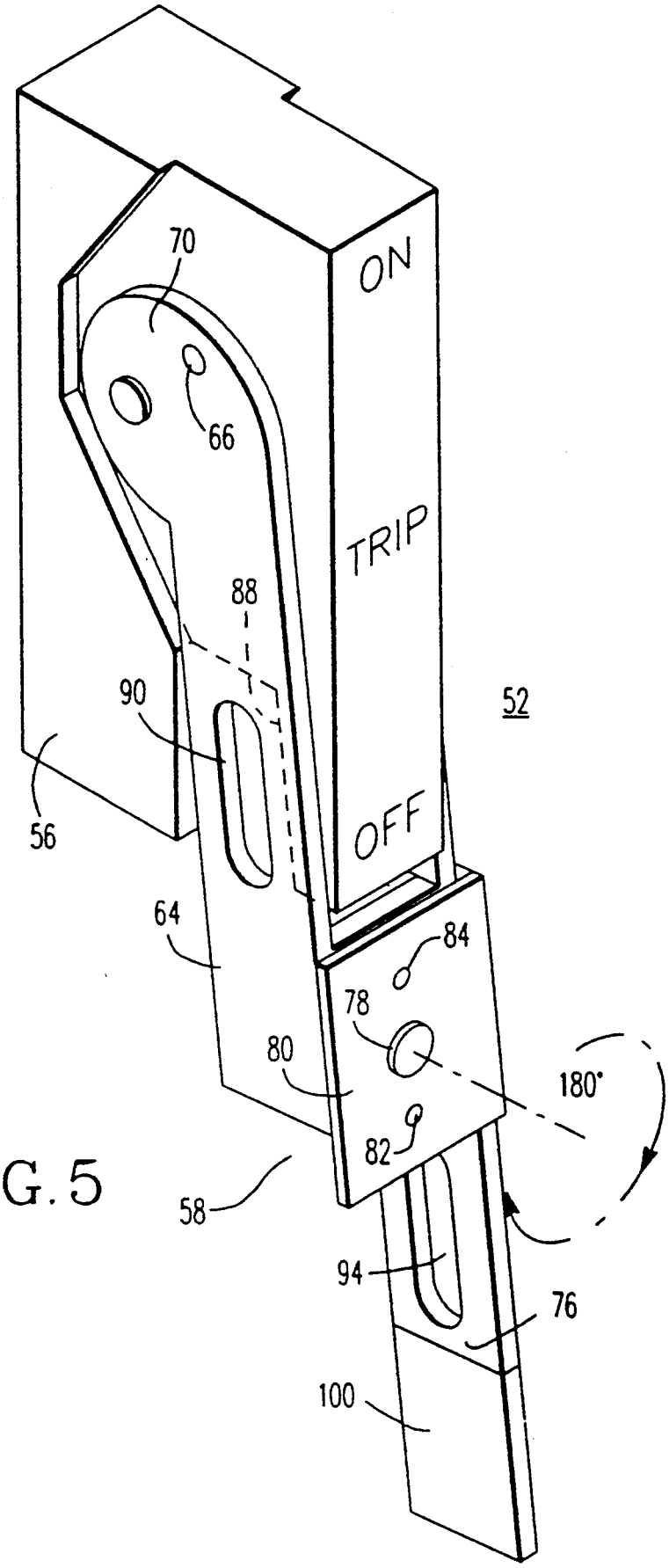
FIG. 5 shows an orthogonal view of the retractable handle mechanism of FIGS. 3 and 4.
Figure 6:
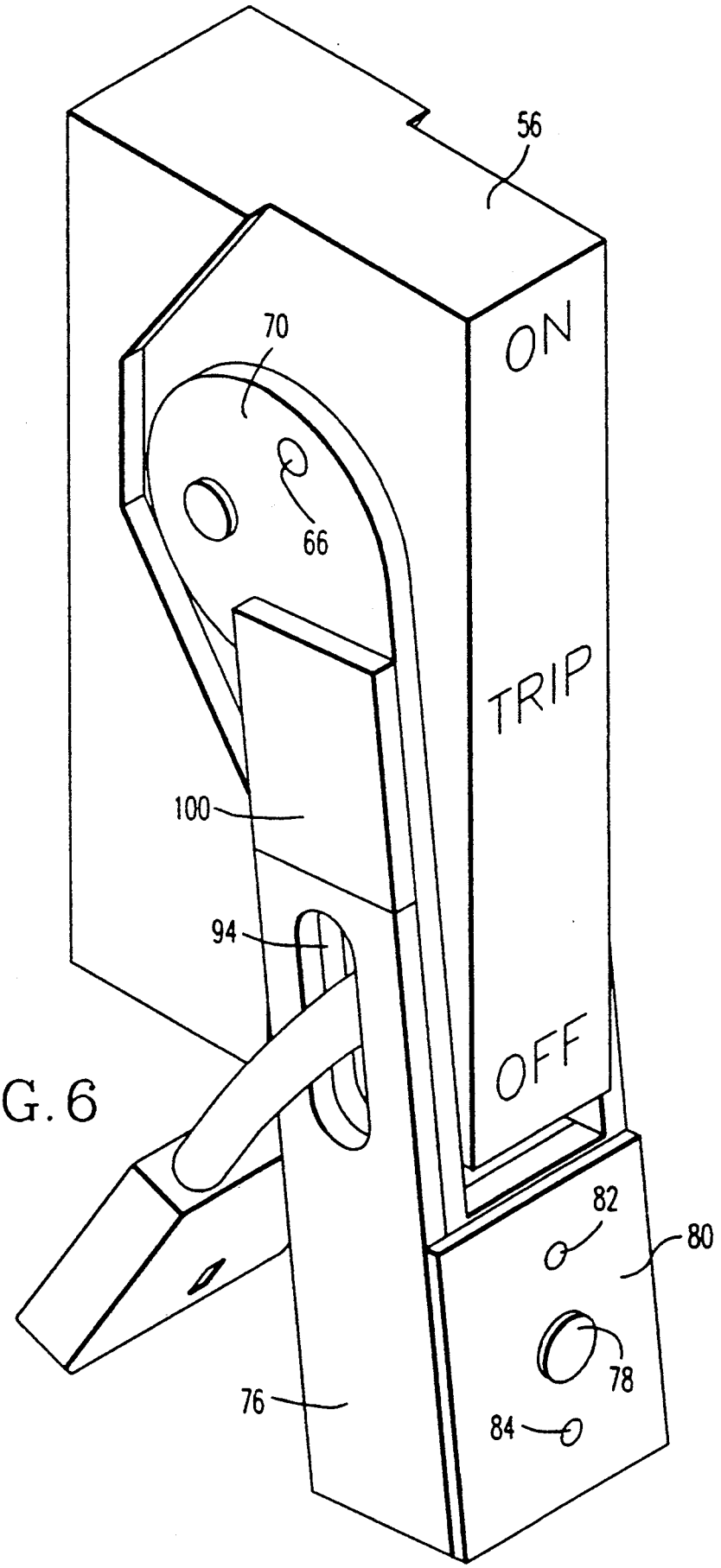
FIG. 6 shows an orthogonal view of the retractable handle mechanism of FIG. 5 in its locked off position.
Figure 7:
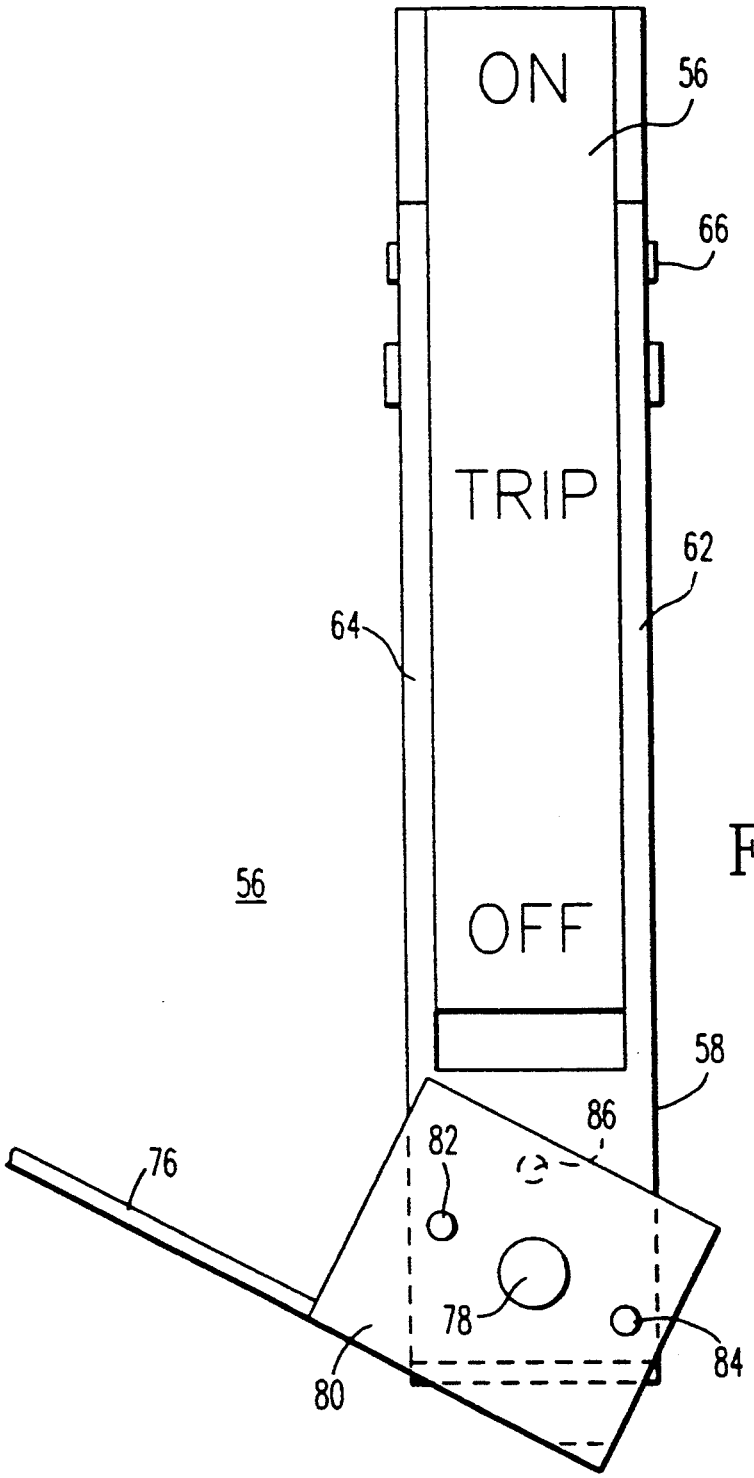
FIG. 7 shows a plan view of the retractable handle mechanism of FIG. 5.
Figure 8:
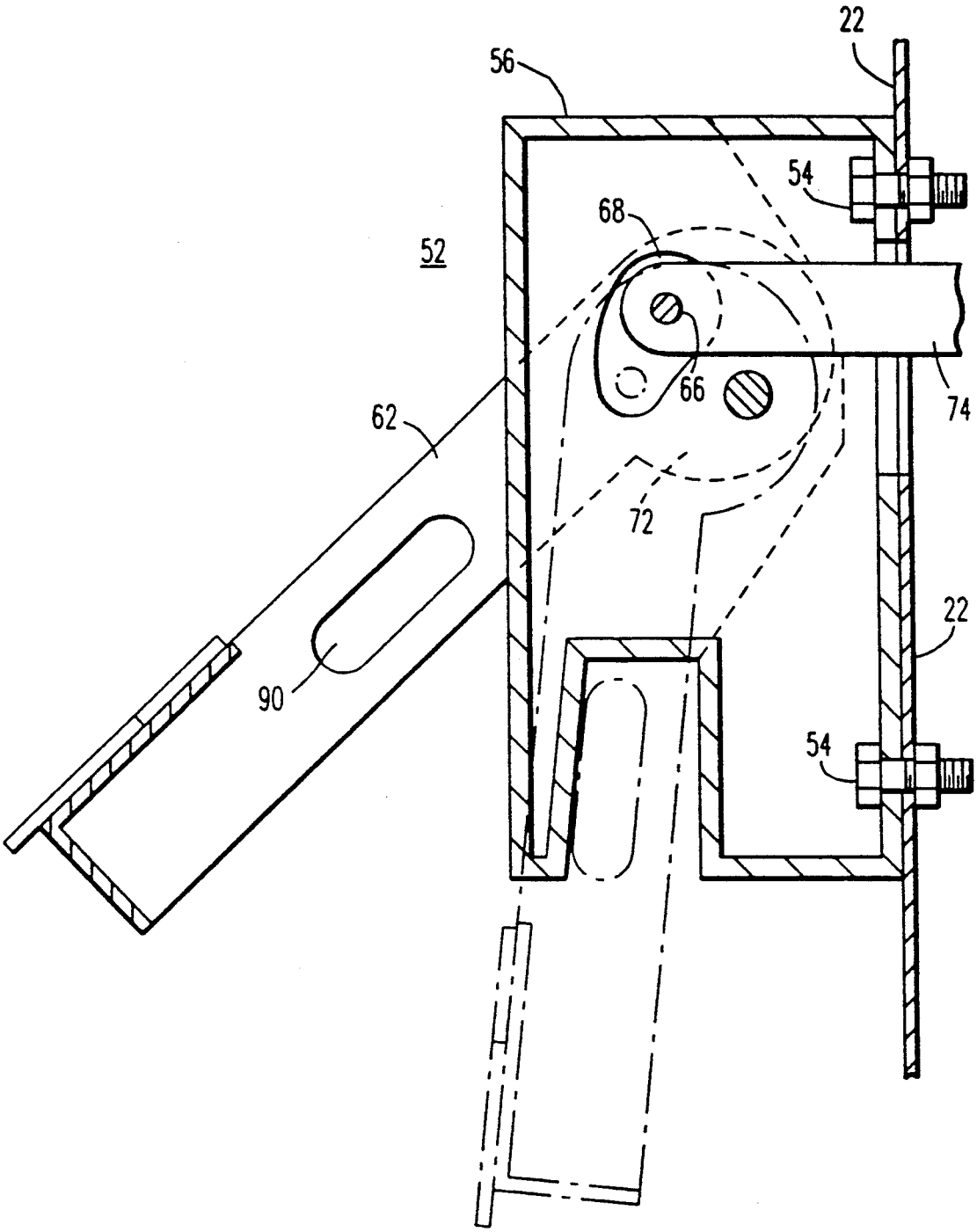
FIG. 8 shows a sectional view of the retractable handle mechanism along section line VIII—VIII of FIG. 7.

Turning to FIGS. 3 and 4, shown is the circuit breaker 20 flange-mounted in a electrical enclosure 22. In the present embodiment, the breaker 20 is mounted in the enclosure 22 utilizing a standard mounting arrangement. It should be appreciated by those skilled in the art that other mounting arrangements may be utilized to secure the breaker 20 within the enclosure 22. The above-handle mounting arrangement includes a backplate and yoke assembly 36, operating rod 38 and brace 40, and a flange mounted pivot mechanism assembly 42. The backplate and yoke assembly 36 may be mounted directly to the back of the electrical enclosure 22 while having secured therein the breaker 20 such that the breaker handle 34 is encaptured within the yoke 44. The yoke 44 may be pivotally attached to the backplate such that the handle 34 remains movable between its on and off positions. Pivotally connected directly to the yoke 44 may be the operating rod 38 while the brace 40 secures the backplate of the backplate and yoke assembly 36 to the flange mounted pivot mechanism assembly 42. The flange mounted pivot mechanism assembly 42 may contain a pair of levers 46 and 48 which radially extend in opposite directions from a pivot bar 50 to which they are non-rotatably attached. The other end of the operating rod 38 may be pivotably connected to the lever 46 while the lever 48 may be pivotably connected to the retractable handle mechanism 52 mounted on the outside of the electrical enclosure 22. It should be noted that the yoke 44 of the backplate and yoke assembly 36 may be connected directly to the retractable handle mechanism 52, the flange mounted pivot mechanism assembly 42 operating to merely translate the motion between two varying planes of operation.

Turning to FIGS. 5–8, the retractable handle mechanism 52 is shown. The retractable handle mechanism 52 may be mounted on the electrical enclosure 22 through the use of bolts 54 directly attached to the handle housing 56. Pivotally attached to the housing 56 is a lever 58. The lever 58 is comprised of two arm segments 62 and 64, one located on each side of the housing 56, and separately pivotally attached to the exterior of the housing along a common axis. This pivotal attachment may be accomplished through the use of rivets. The arm segments 62 and 64 are of sufficient length to allow the lever 58 to be moved over the housing 56 substantially 180 degrees along the vertical plane the housing 56 occupies thereby allowing the lever 58 to be moved from one substantially vertical position (as viewed in FIGS. 3 and 4), which is indicative of the on position, to a second substantially vertical position, which is indicative of the off position.

Within the housing 56, the lever arm segments 62 and 64 may be linked together by a cross bar 66. When the cross bar 66 is utilized, the housing 56 is further provided with openings 68 located at positions under the lever arm bases 70 and 72. The openings 68 allow the crossbar 66 to travel between a first position which results from the lever 58 being positioned in the off position and a second position which results from the lever being positioned in the on position. The two varying positions result from the cross bar being located off the pivot axis of the lever 58. Furthermore, the openings 68 are position under the lever arm bases 70 and 72 as a method of protecting the interior of the enclosure 22 from the environment. Pivotally attached to the cross bar 66 may be a linking rod 74 which in turn may be connected to the lever 48 of the pivot mechanism assembly 42. It should be appreciated by those skilled in the art that the foregoing is illustrative of one of many ways in which the operating handle mechanism 52 may be tied to the operating handle 34 of the circuit breaker 20.

Pivotally attached to the lever 58 is a second lever 76. This pivotal attachment may be accomplished through the use of a shoulder rivet 78. In the illustrated embodiment, the lever 76 is attached to the side of a shoulder plate 80 which is in turn riveted to the top of the lever 58. The pivotal attachment allows the second lever 76 to be rotated substantially through a 180 degree arc of travel thereby allowing the lever 76 to be moved between a first position substantially adjacent the lever 58 to a second position substantially extended away from the lever 58.

The operating handle mechanism 52 may be further equipped with a lever restraining mechanism whereby the lever 76 may be positioned in either its first position or its second position. In the illustrated embodiment, the lever restraining mechanism is constructed with the shoulder plate 80 having a pair of dimples 82 and 84 extending downward toward lever 58 with the top of the lever 58 having a cooperating indentation 86. The dimples 82 and 84 are not large enough to inhibit the movement of the lever 76 but are of sufficient size to prevent unwanted movement of the lever 76 when lodged in the cooperating indentation 86. The dimples 82 and 84 are aligned on the shoulder plate 80 such that they fall into the indentation 86 when the handle is in either its first position or its second position.

A further locking mechanism may be provided to allow the operating handle mechanism 52 to be locked in the off position. In the illustrated embodiment, the locking mechanism consists of a lip 88 formed on the housing 56 which cooperates with the hasp of a padlock which passes through opening 90 in leg 64, opening 92 in leg 62, and opening 94 in lever 76. When lever 76 is positioned substantially adjacent lever 58 (in a non-extended position) the openings 90, 92, and 94 are aligned under the lip 88 when the lever 58 is placed in its off position. The hasp of the padlock engages the lip 88 when the lever is attempted to be moved toward its on position whereby further movement of the handle is inhibited. As a further safety feature, the padlock also operates to prevent the lever 76 from being extended away from lever 58 thereby keeping the handle mechanism within the safety size requirements.

While in the present embodiment the housing 56, lever 58, and lever 76 are constructed of steel, any rigid material, capable of withstanding the stresses of operation will suffice. When the components used are conductive, as in the present embodiment, a plastic cover 100 may be provided to provide some electrical isolation between the operator and the electrical enclosure to which the handle mechanism 52 is attached.

As can be seen in the accompanying drawings, the handle mechanism 52 may be utilized to directly control the operating handle 34 of the circuit breaker 20. Furthermore, when the operating handle 34 of the circuit breaker 20 moves to its trip position, the operating handle mechanism 52 may be moved to correspondingly indicate a trip condition. Specifically, as the lever 58 is moved between its off position and its on position (correspondingly the lever 76 may be extended to increase the leverage being applied) the cross bar 66 follows along and with it the linking rod 74. The linking rod 74 may move either linearly inward toward the handle mechanism 52 (pulling upon the lever 48) when the lever 58 is moved towards its off position, or linearly outward toward the circuit breaker 20 (pushing upon the lever 48) as the lever is moved towards its on position. Correspondingly, the flange-mounted pivot mechanism assembly 42 causes the pivot bar 38 to linearly move in a direction opposite the direction the linking rod 74 travels. If the pivot bar 38 is moved such that the yoke 44 is caused to be pulled toward the pivot mechanism assembly 42, the yoke 44, being pivotally mounted, rotates to raise the handle 34 trapped therein to the circuit breaker on position. If the pivot bar 38 is moved such that the yoke 44 is caused to be pushed away from the pivot mechanism assembly 42, the yoke 44 will rotate to lower the handle 34 to the circuit breaker off position. The off and on positions of the handle mechanism 52 thereby correspond to the off and on positions of the handle 34 of the circuit breaker 20. In a similar fashion, when the handle 34 is caused to move from its on position to its tripped position, the handle mechanism 52 will likewise, through the links and pivot mechanism assembly, be caused to move to a position between its on and off positions.

It is to be understood that the description and drawings shown with respect to the present invention are not limiting and that other retractable handle mechanisms variably linked to a circuit breaker handle mounted within a variety of electrical enclosures have been contemplated.

The present invention has provided among other things a solution to the problem of providing an handle operating mechanism capable of providing increased leverage while remaining within acceptable size limitations.

We claim:

1. A handle operating mechanism, comprising:

a housing;

a first lever pivotally mounted on said housing and movable substantially 180° in an arcuate path between an on position and an off position;

a second lever movable substantially 180° in an arcuate path substantially non-coplanar with the arcuate path said first lever travels;

retraction means for retractably connecting said second lever to said fist lever and for allowing said second lever to be moved between a first position substantially adjacent said first lever to a second position substantially extended away from said first lever; and lever restraining means integral with said retraction means for restraining said second lever in either of its said first position or its said second position;

wherein said lever restraining means comprises said second lever having a shoulder plate, with said shoulder plate having a pair of dimples, and said first lever having a cooperating indentation, wherein one of said dimples is engageable with said indentation for the purpose of restraining said second lever in said first position and the other of said dimples is engageable with said indentation for the purpose of restraining said second lever in said second position.

2. The handle operating mechanism of claim 1, wherein said housing has a lip and said first lever has an opening, said opening being aligned under said lip and cooperable therewith when said first lever is in the off position for preventing movement of said first lever to the on position when a padlock hasp is passed through said opening.

3. The handle operating mechanism of claim 1, wherein said first lever has a pair of leg segments, said leg segments each being pivotally attached to said housing along a common axis; and wherein said housing has a lip and said leg segments each has an opening, said openings being aligned under said lip and cooperable therewith when said first lever is in the off position for preventing movement of said first lever to the on position when a padlock hasp is passed through said openings.

4. The handle operating mechanism of claim 3, wherein said second lever has an opening, said opening being aligned with said openings on said leg segments of said first lever when said second lever is in said first position.

5. The handle operating mechanism of claim 4, wherein said second lever further has a plastic cover disposed thereon.

6. A circuit breaker assembly, comprising:

an electrical enclosure;

a circuit breaker having an operating handle mounted in said electrical enclosure;

a housing mounted on said electrical enclosure;

a first lever pivotally mounted on said housing and movable substantially 180° in an arcuate path between an on position and an off position;

linking means for connecting said first lever to said operating handle of said circuit breaker;

a second lever movable substantially 180° in an arcuate path substantially non-coplanar with the arcuate path said first lever travels;

retraction means for retractably connecting said second lever to said first lever and for allowing said second lever to be moved between a first position substantially adjacent said first lever to a second position substantially extended away from said first lever; and lever restraining means integral with said retraction means for restraining said second lever in either of its said first position or its said second position;

wherein said lever restraining means comprises said second lever having a shoulder plate, with said shoulder plate having a pair of dimples, and said first lever having a cooperating indentation, wherein one of said dimples is engageable with said indentation for the purpose of restraining said second lever in said first position and the other of said dimples is engageable with said indentation for the purpose of restraining said second lever in said second position.

7. The circuit breaker assembly of claim 6, wherein said housing has a lip and said first lever has an opening, said opening being aligned under said lip and cooperable therewith when said first lever is in the off position for preventing movement of said first lever to the on position when a padlock hasp is passed through said opening.

8. The circuit breaker assembly of claim 6, wherein said first lever has a pair of leg segments, said leg segments each being pivotally attached to said housing along a common axis; and wherein said housing has a lip and said leg segments each has an opening, said openings being aligned under said lip and cooperable therewith when said first lever is in the off position for preventing movement of said first lever to the on position when a padlock hasp is passed through said openings.

9. The circuit breaker assembly of claim 8, wherein said second lever has an opening, said opening being aligned with said openings on said leg segments of said first lever when said second lever is in said first position.

10. The circuit breaker assembly of claim 9, wherein said second lever further has a plastic cover disposed thereon.

* * * * *